United States Patent [19]

Whiteside et al.

[11] 3,942,769

[45] Mar. 9, 1976

[54] COMPOSTING UNIT

[76] Inventors: Peter Maurice Whiteside; Desmond Maxwell Westlake, both of Unit 2, Lot 125 Balcatta Beach Road, Hamersley, Australia

[22] Filed: Jan. 31, 1974

[21] Appl. No.: 438,395

[52] U.S. Cl. ..... 259/81 R

[51] Int. Cl.[2] ..... B01F 9/02

[58] Field of Search ..... 259/81 R, 89, 3, 14, 30, 259/57, 90, 175, 176, 177 R; 15/90

[56] References Cited

UNITED STATES PATENTS

| | | | |
|---|---|---|---|
| 88,674 | 4/1869 | Silver | 259/90 |
| 122,357 | 1/1872 | Butt | 259/81 |
| 429,707 | 6/1890 | Westphal | 259/81 |
| 838,661 | 12/1906 | Stadtmuller | 259/81 |
| 1,283,486 | 11/1918 | Fay | 259/81 |
| 1,486,686 | 3/1924 | Roecker | 259/81 |
| 1,606,322 | 11/1926 | Scrive | 259/89 |
| 1,718,180 | 6/1929 | Otterstrom | 15/90 |
| 2,172,914 | 9/1939 | Seams | 15/90 |
| 2,565,385 | 8/1951 | Lupo | 259/89 |
| 3,134,203 | 5/1964 | Roberts | 259/81 |
| 3,386,718 | 6/1968 | Abbott | 259/81 |

*Primary Examiner*—Robert W. Jenkins
*Attorney, Agent, or Firm*—Ulle C. Linton

[57] ABSTRACT

A composting unit comprising a container mounted in an elevated position for rotation about a substantially horizontal axis, said container being provided with a door through which material can be placed into and removed from the container.

1 Claim, 3 Drawing Figures

COMPOSTING UNIT

This invention relates to an improved composting unit.

It is well known that in order to ensure composting of organic refuse material within a reasonable period of time the composting material should be turned over at regular intervals.

The object of the present invention is to provide a unit which will facilitate the turning over of the composting material at regular intervals and which also can be readily emptied.

In one form the invention resides in a composting unit comprising a container mounted in an elevated position for rotation about a substantially horizontal axis, said container being provided with a door through which material can be placed into and removed from the container.

The invention will be better understood by reference to one specific embodiment as shown in the accompanying drawings wherein.

Figure 1:
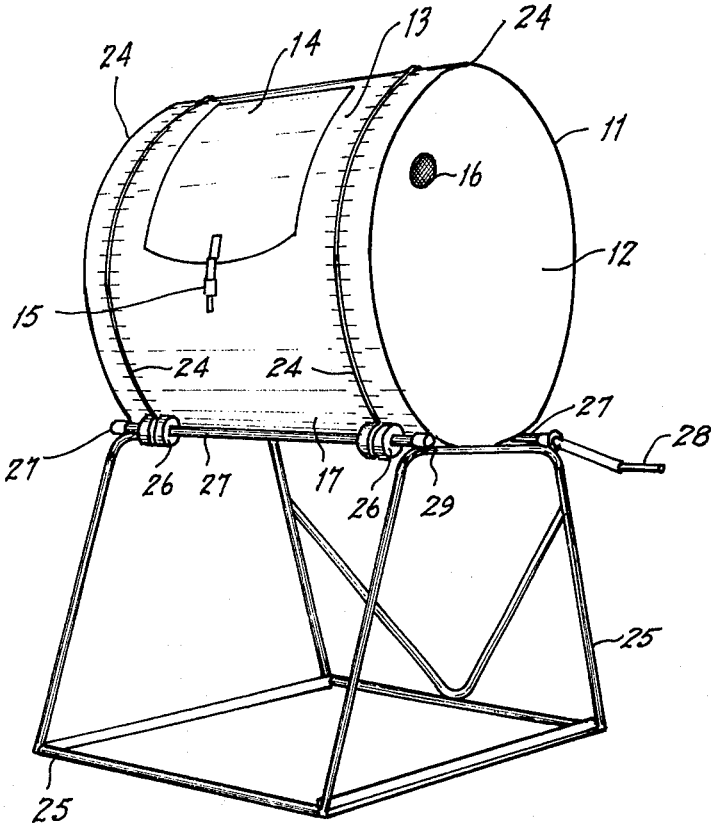
FIG. 1 is a perspective view of the composting unit in an elevated position.
Figure 2:
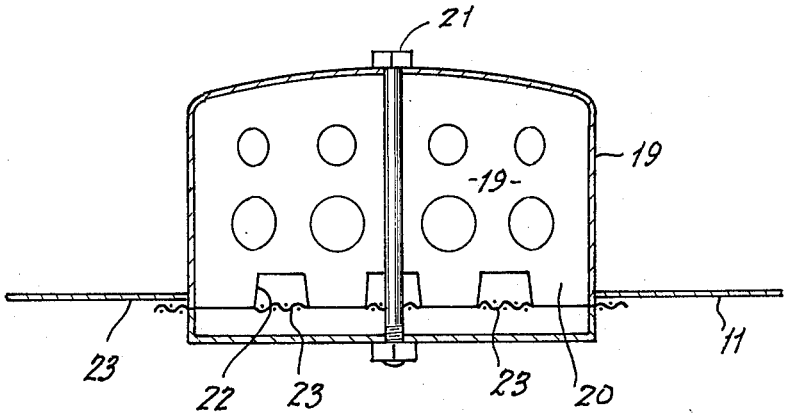
FIG. 2 is a sectional elevation of the base of the composting unit showing a fly-proof aeration drain unit.

In this embodiment, the container 11 is substantially cylindrical and is constructed from sheet metal and is closed at each end 12. The wall 13 of the container 11 is provided with a hinged lid or door 14 adapted to be locked in the closed position by clip 15. The door 14 is removeable to allow an unrestricted opening for filling or emptying of the container 11. Positioned on the ends 12 of container 11 and adjacent the door member 14, are fitted a fly-wire covered opening 16 which allows any excessive generated heat to pass out of the container. The base 17 of the container is fitted with a fly-proof aeration drain unit 18, which comprises a dome shaped structure 19 positioned over the provided recess 20 and held firmly in position by bolt 21. The lower edge of the dome structure 19 is shaped so that any excessive fluid formed within the container 11 during the composting cycle will pass through the space 22 provided and out recess 20. The recess 20 is covered by fly-wire 23 to prevent entry into the container of flies, insects and the like. The cylindrical container is provided with a pair of non-skid or non-slip serrated tracks 24 around its circumference. The container is elevated on stand 25 and is positioned such that the tracks 24 provided on the periphery of the container are in contact with the driving wheels 26 provided on axles 27 of stand 25.

The periphery of the wheels or rollers is serrated to effectively engage the serrations on the container. The wheels 26 are firmly held on axles 27 so that any rotation of the axles 27 by crank handle 28 will cause the wheels 26 to rotate and thereby turn container 11. The outer extremities of axles 27 may be held in freely rotating bearings or housings 29. If desired the handle 28 may be adapted to fit either one of the two axles provided.

In use the container is charged with suitable composting material and the door 14 closed. Thereafter the container is rotated once each day to agitate and turn over the contents. The agitation and the fact that the material is housed in a container which controls the amount of moisture retained within said container, and also controls the passage of air flowing between the fly-proof aeration drain unit 18 and the upper air vents 16 ensures that the material can be composted in less than half the time required for conventional procedures. When composting is complete the container is rotated so that the contents can discharge under gravity into a wheel barrow or other transport unit placed beneath the container. If so desired an open-mesh door may be fitted during the discharge operation. This would ensure that only the completely composted material would fall into the wheel barrow and any partly composted large material would be retained in the container for further treatment.

Figure 3:
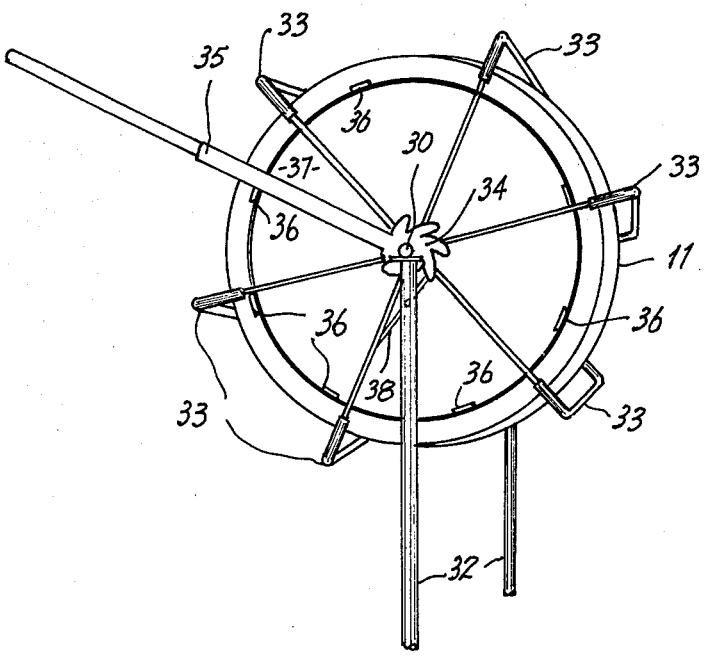
FIG. 3 is an end elevation of an alternative rotation means for the composting unit.

FIG. 3 of the accompanying drawings shows an alternative method of both mounting the container for rotation and means for causing the rotation. In this particular embodiment the container 11 is rotatably mounted for rotation on a substantially horizontal shaft coinciding with the central axis of the container. The ends of the shaft 30 project from each end of the container and are each supported on the upper end 31 of a vertical post 32 so that the lowermost portion of the container which is of about 3 feet in diameter is approximately 2 feet–3 feet above ground level. A series of handles 33 are fixed to the outside of the container at spaced positions. If desired the container 11 may be fitted with internal baffles to assist in agitation of the contents if necessary. In this particular embodiment a ratchet 34 may be fitted to the shaft 30 at each end of the container 11 each ratchet being engaged by a stationary pawl 38 to ensure that the container rotates in one direction only and holds the container in the desired stationary position. The handle 35 may be fitted to one end of the shaft 30 and is used to rotate the container 11 by engaging the handle 35 in one of a series of lugs 36 which are welded to the ends 37 of the container. The handle 35 may be of varying length dependent upon the weight of compost which is required to be turned. Also the container may be fitted with gearing operated by a manual crank or a suitable electric motor to facilitate turning.

We claim:

1. A composting unit comprising a stand, a substantially cylindrical container being mounted in an elevated position on said stand for rotation about a substantially horizontal axis, means for effecting manual rotation of said container, a door being provided in the cylindrical wall of said container through which material to be composted can be loaded into and composted material discharge from said container, a fly proof aeration drain unit being fitted to the wall of said container through which any excess liquid can discharge when said unit is in the lowermost position and through which air can pass into said container and at least one fly proof discharge vent being positioned in at least one wall of said container remote from said aeration drain unit so that air can flow through said container, said seration drain unit comprising a dome shaped member being mounted over a recess formed in the wall of said container, the walls of said domed shaped member being provided with a series of perforated openings and the lower edge of said domed shaped member being provided with a series of castellations through which liquid can drain from said container into said recess and said recess being covered by a fly wire mesh member.

* * * * *